United States Patent [19]

Trayler

[11] 4,068,721

[45] Jan. 17, 1978

[54] BULLDOZER ASSEMBLY WITH LOCKING PIN AND METHOD

[75] Inventor: Robert J. Trayler, Braidwood, Ill.

[73] Assignee: Caterpillar Tractor Co., Peoria, Ill.

[21] Appl. No.: 752,708

[22] Filed: Dec. 20, 1976

[51] Int. Cl.[2] ..... E02F 3/76

[52] U.S. Cl. ..... 172/1; 172/804; 403/114

[58] Field of Search ..... 172/801, 805, 804, 806, 172/1; 403/90, 131, 114, 116

[56] References Cited

U.S. PATENT DOCUMENTS

| | | | |
|---|---|---|---|
| 1,404,860 | 1/1922 | Kelso | 403/116 |
| 2,927,388 | 3/1960 | Skromme | 172/804 |
| 3,002,300 | 10/1961 | Turbyfill | 172/804 |
| 3,059,356 | 10/1962 | Lorang | 172/804 |
| 3,662,838 | 5/1972 | Polzin | 172/805 |
| 3,773,116 | 11/1973 | Coontz | 172/804 |

*Primary Examiner*—Richard J. Johnson
*Attorney, Agent, or Firm*—Phillips, Moore, Weissenberger, Lempio & Majestic

[57] ABSTRACT

A bulldozer assembly comprises a C-frame pivotally connected on a forward end of a tractor and a blade universally connected on a forward end of the frame by a ball and socket connection. A pair of laterally spaced push arms have forward ends thereof universally connected to the blade and rearward ends thereof adjustably mounted on the frame for selectively angling the blade relative to the frame. Prior to such angling, a vertically disposed pin is inserted in the ball and socket connected to prevent tipping of the blade relative to the frame.

12 Claims, 3 Drawing Figures

BULLDOZER ASSEMBLY WITH LOCKING PIN AND METHOD

BACKGROUND OF THE INVENTION

A conventional bulldozer assembly normally comprises a C-frame having a blade pivotally connected forwardly thereon. Such connection may comprise a single ball and socket connection disposed intermediate the ends of the blade to permit tilting, angling and tipping of the blade relative to the frame. The bulldozer assembly may further comprise a pair of laterally spaced push arms having their forward ends pivotally connected to the blade and the rearward ends adjustably mounted on the frame to be selectively reciprocated manually and adjusted to various positions to effect angling of the blade. A common problem arising with such a bulldozer assembly is one of preventing tipping of the blade relative to the frame when manual adjustment of the push arms is made to change the angle of the blade.

SUMMARY OF THIS INVENTION

The present invention is directed to overcoming one or more of the problems as set forth above.

According to the present invention, means are provided for assuring that a bulldozer blade will not tip forwardly or backwardly upon selective angling thereof. The bulldozer assembly of this invention comprises a normally horizontally disposed frame having the normally vertically disposed blade disposed forwardly thereof. A ball and socket connection universally connects the blade to the frame and a pair of laterally spaced push arms have forward ends thereof pivotally connected to the blade.

Rearward ends of the push arms are adjustably mounted on the frame to selectively angle the blade relative to the frame. Prior to such angling, a pin means is removably mounted in the ball and socket connection to prevent tipping of the blade relative to the frame. Such pin means preferably comprises a vertically disposed cotter pin disposed in aligned apertures formed in a bracket and ball of the ball and socket connection.

BRIEF DESCRIPTION OF THE DRAWINGS

Other objects of this invention will become apparent from the following description and accompanying drawings wherein.

DETAILED DESCRIPTION

Figure 1:
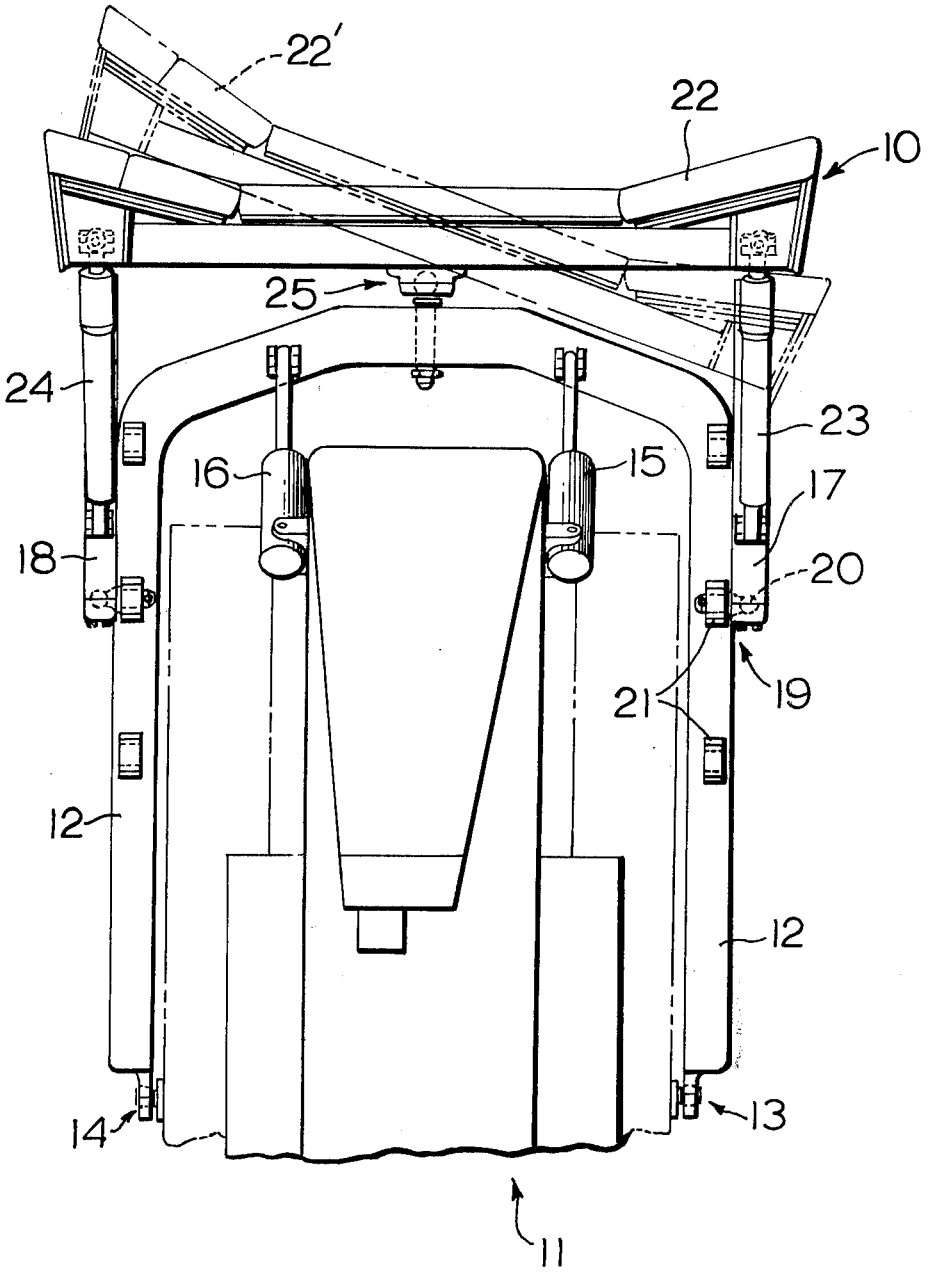
FIG. 1 is a top plan view of a bulldozer assembly mounted on the forward end of a tractor.

FIG. 1 illustrates a bulldozer assembly 10 mounted on the forward end of a track-type tractor 11. The bulldozer assembly comprises a normally horizontally disposed C-frame 12 having rearward ends thereof universally mounted on opposite sides of the tractor by ball and socket connections 13 and 14 in a conventional manner. A pair of laterally spaced double-acting hydraulic lift cylinders 15 and 16 are pivotally interconnected between the frame and the tractor to selectively raise or lower the bulldozer assembly relative to ground level.

A pair of laterally spaced push arms 17 and 18 each has its rearward end universally connected to frame 12 by a ball and socket connection 19. Each connection comprises a ball 20 secured to frame 12 by a bracket 21 and disposed in a mating socket defined on a respective push arm. It should be noted that three longitudinally spaced brackets are attached on the frame in longitudinally spaced relationship to provide selective adjustment of each push arm thereon for purposes hereinafter explained.

The forward end of each push arm is universally connected to a blade 22 of the bulldozer assembly by a ball and socket connection (not shown). A pair of brace means 23 and 24 are pivotally interconnected between the blade and push arms 17 and 18, respectively. The normally vertically disposed blade is adapted to be tilted by at least one of the brace means which may constitute a double-acting hydraulic tilt cylinder or a manually adjustable brace of conventional design. The blade is universally connected to frame 12 directly by a ball and socket connection 25 to normally permit tilting, angling and/or tipping of the blade relative to the frame.

Figure 2:
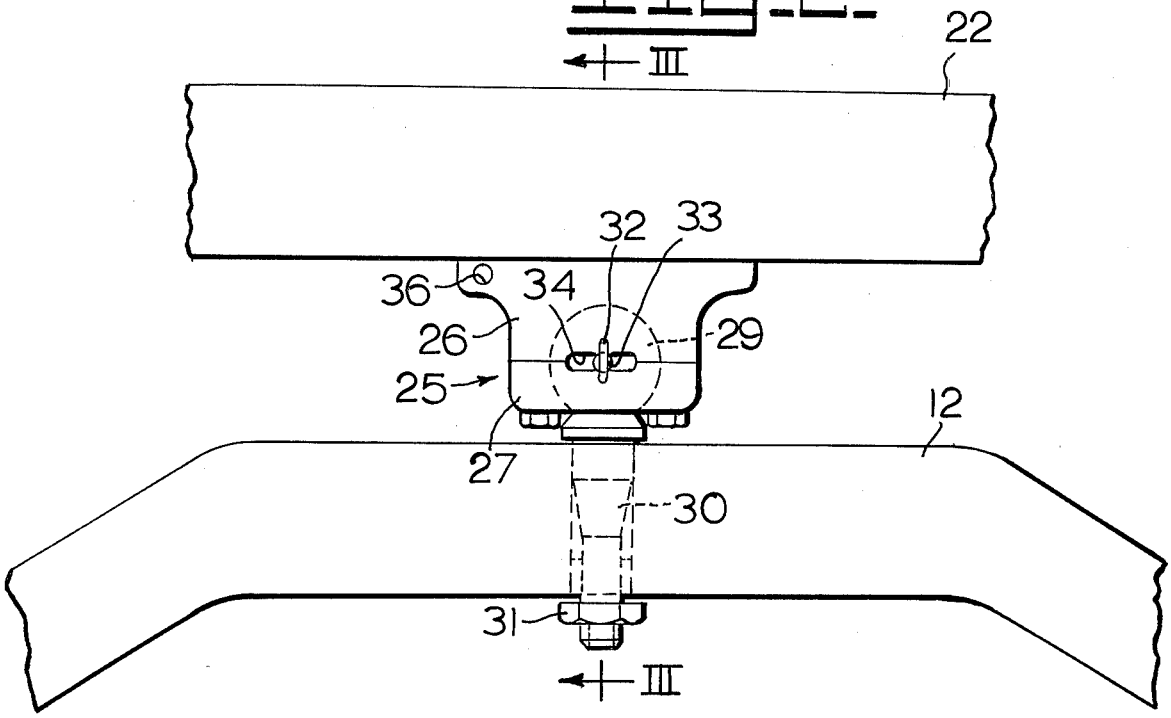
FIG. 2 is an enlarged top plan view, particularly illustrating a ball and socket connection for universally connecting a blade to a C-frame of the bulldozer assembly.
Figure 3:
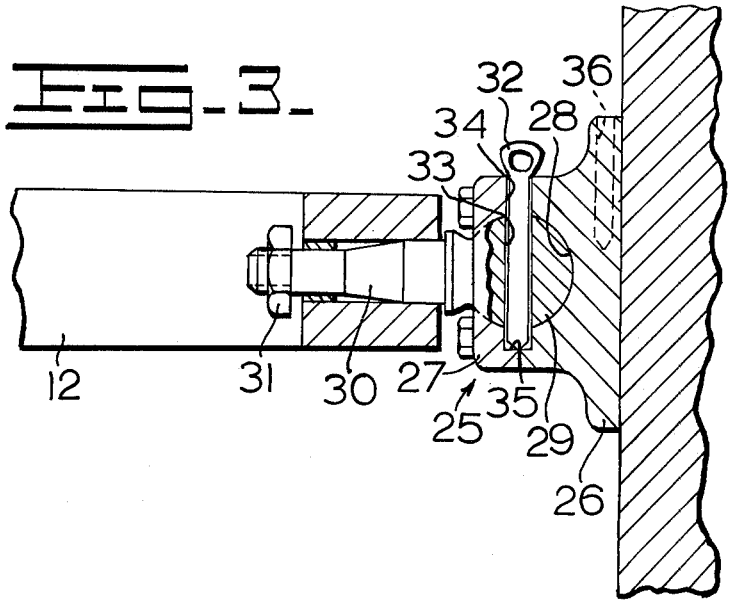
FIG. 3 is a sectional view through the ball and socket connection, taken in the direction of arrows III—III in FIG. 2.

As shown in FIGS. 2 and 3, connection 25 comprises a bracket, including a block 26 secured behind and intermediate the ends of the blade and a removable cap 27. The block and cap define a spherical socket 28 which receives a like-shaped spherical ball 29 therein. The ball is secured to a shank 30 which extends rearwardly through frame 12 and has a nut 31 threadably mounted thereon. It should be noted that clearances are provided between the frame and the nut and the frame and ball 29 to permit shank 30 to reciprocate slightly relative to the frame.

A problem encountered with the selective angling of blade 22 relative to frame 12 is one of preventing tipping of the blade upon selective adjustment of push arms 17 and 18 to dispose the blade at its angled position 22', for example. Such adjustment, of course, is effected by releasing connections 19 for each push arm and by reconnecting the rearward end of push arm 17 to the rearwardmost bracket 21 and by reconnecting the rearward end of push arm 18 to the forwardmost bracket on that respective side of the frame.

Such problem is overcome by initially inserting a pin means, such as a cotter pin 32, through aperture 33, formed centrally through ball 29. Thus, installation of pin 32 in place prior to angling adjustment of the blade to its 22' position in FIG. 1 will prevent the blade from tipping forwardly or rearwardly during such adjustment. It should be noted that transversely disposed apertures or slots 34 and 35 are formed in block 26 and cap 27, on either side of ball 29, to facilitate insertion of pin 32 through aperture 33, i.e., to compensate for any possible misalignment between ball 29 and block 26-cap 27 supporting structure for the ball. Upon completion of such adjustment, the pin may be stored in an elongated aperture 36 formed in block 26.

The embodiments of the invention in which an exclusive property or privilege is claimed are defined as follows:

1. In a bulldozer assembly of the type comprising a normally horizontally disposed frame, a normally vertically disposed blade positioned forwardly of said frame, a ball and socket connection universally connecting said blade to said frame and a pair of laterally spaced push arms having forward ends thereof pivotally connected to said blade and having rearward ends thereof adjustably mounted on said frame for selectively angling said blade relative to said frame, the invention comprising pin means removably mounted in said ball and socket connection for preventing tipping of said blade relative to said frame upon angling thereof.

2. The bulldozer assembly of claim 1 wherein said pin means constitutes a single pin disposed vertically in said ball and socket connection.

3. The bulldozer assembly of claim 1 wherein said ball and socket connection comprises a bracket secured to a back side of said blade and defining a spherical socket therein and a ball connected to a forward end of said frame and disposed in said socket.

4. The bulldozer assembly of claim 1 further comprising an adjustable brace means pivotally interconnected between one of said push arms and said blade for selectively tilting said blade relative to said frame.

5. The bulldozer assembly of claim 1 further comprising a tractor and wherein said frame comprises a C-frame having rearward ends thereof pivotally attached to opposite sides of said tractor.

6. The bulldozer assembly of claim 5 further comprising a pair of laterally spaced double-acting cylinders pivotally interconnected between said tractor and said frame for selectively raising and lowering said frame relative to ground level.

7. The bulldozer assembly of claim 3 wherein said pin means is disposed in vertically aligned apertures formed in said bracket and through said ball.

8. The bulldozer assembly of claim 3 further comprising means defining an elongated aperture in said bracket adapted to receive said pin means therein when said pin means is removed from said ball and socket connection for storage purposes.

9. The bulldozer assembly of claim 3 wherein said bracket comprises a block secured to said blade and a cap attached to said block.

10. A method for adjusting the angling of a blade relative to a frame of a bulldozer assembly wherein the blade is universally connected to said frame by a ball and socket connection comprising the steps of inserting a pin in said ball and socket connection to prevent tipping of said blade relative to said frame, and angling said blade relative to said frame.

11. The method of claim 10 wherein said inserting step comprises inserting said pin vertically through a bracket and ball of said ball and socket connection.

12. The method of claim 10 wherein said angling step comprises adjustably mounting a pair of push arms on said frame.

* * * * *

Disclaimer 4,068,721.—*Robert J. Trayler,* Braidwood, Ill. BULDOZER ASSEMBLY WITH LOCKING PIN AND METHOD. Patent dated Jan. 17, 1978. Disclaimer filed Mar. 2, 1982, by the assignee, *Caterpillar Tractor Co.*

Hereby enters this disclaimer to all claims of said patent.

[*Official Gazette May 4, 1982.*]